US006836987B1

(12) United States Patent
McMahan

(10) Patent No.: US 6,836,987 B1
(45) Date of Patent: Jan. 4, 2005

(54) MAGNETIC LIST AND METHOD FOR MAKING LISTS

(76) Inventor: Marcus David McMahan, 12725 Nelda La., Herald, CA (US) 95638

( * ) Notice: Subject to any disclaimer, the term of this patent is extended or adjusted under 35 U.S.C. 154(b) by 0 days.

(21) Appl. No.: 10/081,004

(22) Filed: Feb. 20, 2002

(51) Int. Cl.[7] ..... G09F 7/04
(52) U.S. Cl. ..... 40/600; 40/621
(58) Field of Search ..... 40/600, 621, 661.01

(56) References Cited

U.S. PATENT DOCUMENTS 2,599,047 A * 6/1952 Clark ..... 335/285
3,093,919 A * 6/1963 Holtz ..... 40/621
3,769,720 A * 11/1973 Terrones ..... 434/127
4,817,320 A * 4/1989 Fraynd ..... 40/621
5,934,707 A * 8/1999 Johnson ..... 40/110
6,464,507 B1 * 10/2002 Bailey ..... 434/247

* cited by examiner

*Primary Examiner*—Cassandra Davis
(74) *Attorney, Agent, or Firm*—Risto A. Rinne, Jr.

(57) ABSTRACT

An apparatus for creating a list includes a planar base member and a plurality of magnetic items that are detachable apart from the base member. The desired magnetic items form the items to be included on the list and they are selected from amongst the plurality of magnetic items and are placed proximate the base member. The base member and the desired magnetic items are used as a portable list or, alternatively, a piece of paper is placed over the magnetic items and a force is applied to the surface of the paper, for example rubbing it with the side of a pencil, which affects the paper to transfer a legible representation of the magnetic items to the paper. The paper is then used as the portable list.

15 Claims, 2 Drawing Sheets

MAGNETIC LIST AND METHOD FOR MAKING LISTS

BACKGROUND OF THE INVENTION

1. Field of the Invention

The present invention, in general relates to grocery lists and the like and, more particularly, to magnetic lists.

People frequently use lists when shopping. For example, it is common to make a grocery list and then take that list to the supermarket to use, checking off items once they have been placed in the shopping cart. When shopping in department stores or running assorted errands, people often rely upon lists to ensure that nothing is overlooked.

Even though lists are especially useful, people still sometimes fail to use them when they might be of advantage because making and updating a list itself takes time. For example, when most of the items on a list have been obtained, but not every item, the list to some degree becomes obsolete.

This is because people generally do not see much value in having (i.e., carrying) a list that contains only one item on it, for example. While it is reasonable to expect people to carry over any remaining items from an older list forward to a new list, people often don't bother doing so and, consequently, the remaining items from the old list risk being overlooked.

It is desirable to facilitate the creation of shopping lists and to make as easy as possible the ability to update those lists.

Furthermore, certain types of stores may wish to provide their customers with a list that is tailored to the items that their particular store markets. For example, a wholesale type of a store might wish to provide customers with a list that contains the generic item types found in that store as a means to promote shopping there.

A brand name type of a cereal manufacturer might provide a shopping list in the cereal container that includes, as one possible item for inclusion on the list, the brand name of that particular cereal as well as the brand names of other cereals that are made by that company.

Accordingly there exists today a need for a product and method that facilitates the formation of a list.

Clearly, such an apparatus and method would be useful and desirable.

2. Description of Prior Art

Lists are, in general, known. While the structural arrangements of the above described devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a magnetic list that is inexpensive to manufacture.

It is also an important object of the invention to provide a magnetic list that can be used for sales promotion purposes.

Another object of the invention is to provide a magnetic list that can be taken when shopping.

Still another object of the invention is to provide a magnetic list that can remain at one location and be used to create a second list that is readily transportable.

Still yet another object of the invention is to provide a magnetic list that can include items that appertain to the products or services of a particular company.

Yet another important object of the invention is to provide a magnetic list that can be tailored to ethnic interests.

Still yet another important object of the invention is to provide a magnetic list that uses icons to identify products.

One further object of the invention is to provide a magnetic list that includes words (i.e., letters) to identify products.

One still further object of the invention is to provide a magnetic list that includes raised or recessed letters to identify products.

One still further important object of the invention is to provide a magnetic list that includes an ornamental representation that agrees with the theme of products and services offered by the company.

Briefly, a magnetic list that is constructed in accordance with the principles of the present invention has a planar base member and a plurality of magnetic items that are detachable apart from the base member. A list is formed by placing the desired magnetic items proximate the base member. The base member and magnetic items can then be taken as a portable list or, alternatively, a piece of paper can be placed over the magnetic items and by applying a force over the paper, such as rubbing it with the side of a pencil, a legible representation of the magnetic items is transferred to the paper which is then used as the portable list.

DETAILED DESCRIPTION OF THE INVENTION

Figure 1:
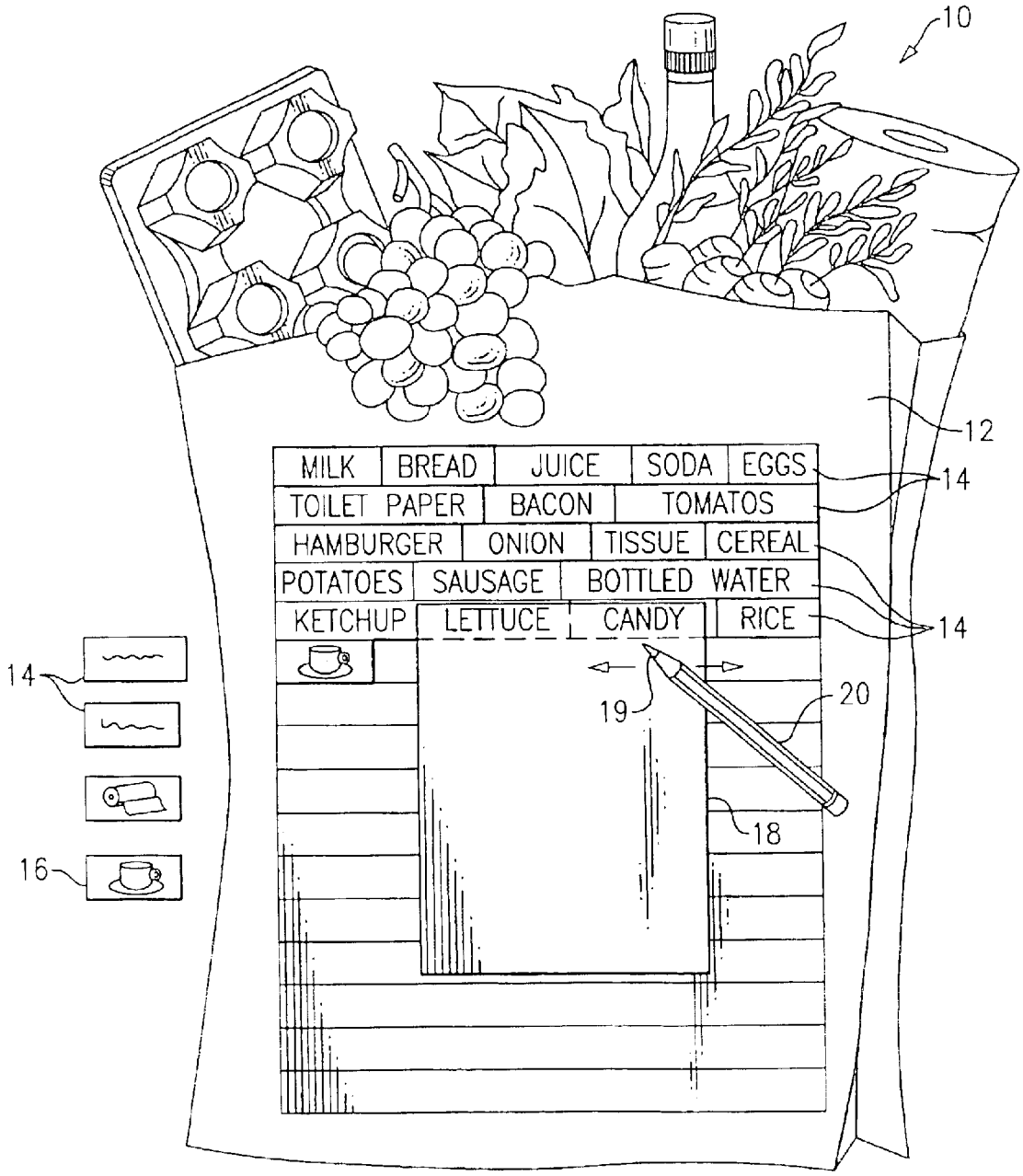
FIG. 1 is a front elevational view of a list for use in grocery shopping.

Referring to FIG. 1 is shown, a grocery list, identified in general by the reference numeral 10.

The grocery list 10 includes a planar base 12 that preferably is ornamental with a theme that suggests its use (i.e., for groceries). As shown the planar base 12 has the appearance of a grocery bag with items sticking out of the top, although other representations could be shown, for example, instead of a bag a grocery store type of a shopping cart (not shown) or other design could be used.

The planar base 12 is preferably formed of a flexible magnetic material and is placed on a refrigerator (not shown) or the like. Alternately, the planar base 12 can be attached with VELCRO or by any suitable detachable method.

A plurality of individual magnetic items 14 are shown on the planar base 12 that include the names of the desired types of items printed thereon, preferably with either raised or recessed lettering.

Also shown, is a pictorial magnetic item 16 that shows a coffee cup and is used to remind the shopper to obtain coffee. The pictorial magnetic item 16 is an icon and, preferably, includes either a raised or a recessed image.

The magnetic items 14 and the pictorial magnetic item 16 (or items) that are desired are placed on the planar base 12 to which they adhere magnetically, because the planar base 12 either attracts them because it too is magnetic or it must alternatively include a ferrous material.

Other magnetic items 14 and pictorial magnetic items 16 are included with the grocery list 10 (or can be purchased later). These are placed aside the grocery list 10 and, when they are to be included in the grocery list 10, they are lifted and placed on the planar base 12.

In use the grocery list 10 is removed from the refrigerator and taken shopping. As the actual items (not shown) are obtained, the magnetic items 14 and pictorial magnetic items 16 can be removed from the top of the grocery list 10, for example, and placed at the bottom or back of the base 12 to indicate that they have been obtained.

If either raised or recessed letters of images are used with the magnetic items 14 or pictorial magnetic items 16, a piece of paper 18 can be temporarily placed and held over the grocery list 10 and a force can be applied to the top of the paper 18 such as rubbing it with a lead point 19 of a pencil 20 that is moved side to side.

This will transcribe the desired items (either the magnetic items 14 or the pictorial magnetic items 16 or both) to the paper 18 by creating a darkened pencil image of raised letters or images on a lighter pencil background that is legible and sufficient to rapidly create a second portable list on the paper 18. If the letters or images are recessed, they will appear lighter than the background.

When the shopper returns home, the items that were obtained are removed off of the planar base 12 and the remaining items still needing to be acquired are left on the planar base 12. Other items that are needed are added for use in readily generating another current paper type of a list or the entire grocery list 10 can be taken.

While the paper 18 as shown is small and only covers a portion of the items 14, a larger piece of paper can, of course, be used to transcribe the entire grocery list 10.

The use of a smaller piece of paper 18 allows for a user to make the second portable list that includes only selected items from the grocery list 10. To do this the paper 18 is placed over the selected items and the pencil 20 is rubbed only upon the selected items.

This is useful if the shopper is going to go to a convenience store (instead of a supermarket) and only wishes to obtain a few of the most important items.

The magnetic items 14 or the pictorial magnetic items 16 could include specific brand names of products. If desired, the manufacturer of the brand name product could include such a list along with their products. They might well include the brand names of every product that they produce as possible magnetic items 14 or as possible pictorial magnetic items 16 (if there is a logo or other brand name identification present) while only including generic names of other products.

This is useful to promote sales of their particular products, instead of generic products. For example, a manufacturer of cereal would not want to say cereal but rather to say the specific brand names of the cereals that they produce. If the list (or second portable list) is then given to another person, they are almost certain to obtain the brand name item rather than a generic cereal, for example.

Also, the companies that provide such types of lists may in fact include the brand names of products that they do not produce when these products do not compete with their own product lines. This may be done when cross-agreements with other manufactures reciprocate the favor or if the other manufacturers pay them to do so (as another form of advertising).

Figure 2:
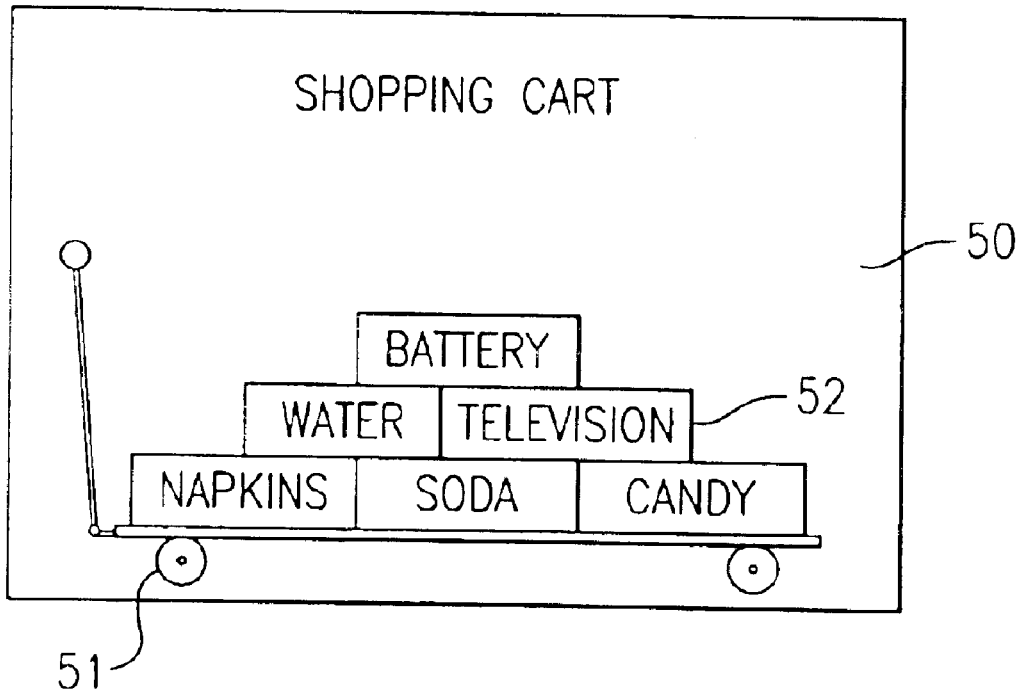
FIG. 2 is a front elevational view of a list for use in shopping at a warehouse or department type of a store.

Referring now to FIG. 2 is shown a modified base 50 that preferably includes an ornamental representation of the desired theme. In the illustration, the modified base 50 includes a picture of a shopping cart 51, of the type that is commonly used in wholesale warehouse types of stores.

The user places all desired items 52 that correspond with the items offered for sale on the image of the cart on the modified base 50.

This illustrates how different types of stores can offer such a type of a list for their customers to use when shopping at that store. The modified base 50 and shopping list is used in a manner similar to the grocery list 10 as was described hereinabove.

Name brands of products they sell could be included as the individual items 52.

Other modifications are possible for the instant invention. For example, the various magnetic items 14 or the pictorial magnetic items 16 may be included as part of the base 12. When they are separated from the base 12, a hole is formed in the base where the magnetic items 14 or the pictorial magnetic items 16 were located. The refrigerator (for example) would be underneath. The desired magnetic items 14 or the pictorial magnetic items 16 are then placed in the hole in the base 12.

However, in this instance the paper 18 must be used to form a second portable list because if the base 12 were removed from the refrigerator, the magnetic items 14 and the pictorial magnetic items 16 would remain behind attached to the refrigerator.

The magnetic items 14 and the pictorial magnetic items 16 can also be tailored to match various ethnic preferences. For example, a Mexican version could include popular Mexican foodstuffs.

The magnetic items 14 and the pictorial magnetic items 16 can also be tailored to include various preferences within a given product line. For example, a list of beers (not shown) can include different generic as well as different brand name beers, including light beers, dark beers, lagers, etc.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A magnetic list, comprising:

(a) a planar base, and wherein said planar base is formed of a flexible material and wherein said planar base is adapted to be secured to a planar surface, said planar surface being formed of a ferrous material; and (b) a plurality of individual items, each of said individual items being magnetic and adapted to adhere to said planar surface proximate said planar base; and wherein said planar base includes a hole, said hole providing access to said planar surface, and wherein said hole is adapted to receive certain of said plurality of individual items therein, and wherein certain of said plurality of individual items are retained in said hole by magnetic adhesion to said planar surface.

2. The magnetic list of claim 1 wherein said flexible material is magnetic.

3. The magnetic list of claim 2 wherein said flexible material includes a ferrous substance.

4. The magnetic list of claim 1 wherein said planar base includes an ornamental shape.

5. The magnetic list of claim 1 wherein said planar base includes an ornamental image.

6. The magnetic list of claim 1 wherein said plurality of individual items each include the name of an item.

7. The magnetic list of claim 6 wherein said name includes raised letters.

8. The magnetic list of claim 6 wherein said name includes recessed letters.

9. The magnetic list of claim 1 wherein said plurality of individual items each include an image of an item.

10. The magnetic list of claim 9 wherein said image is raised.

11. The magnetic list of claim 9 wherein said image is recessed.

12. The magnetic list of claim 9 wherein said image includes an icon.

13. The magnetic list of claim 1 wherein each of said plurality of individual items includes a magnetic segment that is detachable with respect to said planar base.

14. A method for forming a list, which comprises steps of:

(a) providing a flexible magnetic planar base that is adapted for attachment to a ferric material;

(b) providing a plurality of individual items, each of said individual items including means for identifying a particular type of product that is either raised or recessed, any of said plurality of individual items being adapted for placement proximate said base;

(c) placing a piece of paper over said individual items proximate said base; and (d) applying a force over said piece of paper sufficient to copy an image of said any of said plurality of individual items to said piece of paper.

15. The method for forming a list of claim 14 wherein said force is applied over only a portion of said individual items sufficient to produce an abbreviated list thereof.

* * * * *